United States Patent [19]

Murray

[11] 4,142,562

[45] Mar. 6, 1979

[54] AUTOMATIC SHUT-OFF NOZZLE HAVING UNIQUE VALVE

[75] Inventor: Robert L. Murray, Dayton, Ky.

[73] Assignee: Dover Corporation, New York, N.Y.

[21] Appl. No.: 776,944

[22] Filed: Mar. 14, 1977

[51] Int. Cl.[2] ..... B65B 57/14

[52] U.S. Cl. ..... 141/206; 251/358

[58] Field of Search ..... 141/198, 206–229, 141/392, 59, 290; 137/DIG. 3; 251/332, 358

[56] References Cited

U.S. PATENT DOCUMENTS

| | | | |
|---|---|---|---|
| 2,523,864 | 9/1950 | Delany | 251/358 |
| 2,827,929 | 3/1958 | McCarty | 141/209 |
| 3,866,636 | 2/1975 | Lasater | 141/59 |
| 4,015,647 | 4/1977 | Nelson | 141/206 |

*Primary Examiner*—Richard E. Aegerter
*Assistant Examiner*—Frederick R. Schmidt
*Attorney, Agent, or Firm*—John G. Schenk

[57] ABSTRACT

An automatic shut-off nozzle has its valve, which controls liquid flow from its inlet to its outlet, arranged to provide a minimum flow rate to prevent recycling of fuel irrespective of the angle of the fill pipe.

23 Claims, 6 Drawing Figures

AUTOMATIC SHUT-OFF NOZZLE HAVING UNIQUE VALVE

When filling a vehicle tank with gasoline through a dispensing nozzle, vapors from the gasoline within the tank can be prevented from escaping through the fill pipe opening in which the spout of the nozzle is inserted by sealing the fill pipe opening. Thus, the escape of the gasoline vapors into the atmosphere is prevented so that pollution of the atmosphere is decreased. The vapors within the tank can be recovered through vapor recovery equipment utilized in conjunction with the nozzle.

However, with vapor recovery arrangements, it is necessary for there to be automatic shut off of the supply of the gasoline. This is because the attendant cannot see the level of the gasoline within the vehicle tank being filled because of the sealing of the fill pipe opening.

Therefore, the supply of gasoline to the vehicle tank must be automatically stopped. The automatic shut-off mechanism depends upon the level of the liquid in the tank reaching a predetermined level at which it blocks a vacuum passage opening in the nozzle spout to cause activation of release means to move the valve, which is controlling liquid flow from the inlet to the outlet of the nozzle body, to its closed position.

However, with certain vehicles, the fill pipe of the gasoline tank is disposed almost horizontal. When the fill pipe of the gasoline tank is disposed almost horizontal, the position of the spout in the fill pipe opening is such that the vacuum tube opening in the spout tends to be in the upper portion of the fill pipe opening. With the fill pipe opening almost horizontal, the level of the gasoline therein will not always reach this vacuum tube opening in the spout before the gasoline will tend to flow into the vapor return passage, which is formed between the seal and the spout nozzle, since the vapor return passage must be communicating with the fill pipe to remove the vapors from the tank.

Therefore, by pumping the gasoline at a very low rate through the spout into the tank, turbulence and/or foam is not necessarily produced in the gasoline within the fill pipe to block the vacuum tube opening in the spout. Accordingly, the gasoline is pumped into the fill pipe and then returned to the vapor recovery equipment through the vapor return passage. As a result, the customer pays for gasoline not received since the pumping of the gasoline is utilized to determine the quantity supplied to the customer.

The present invention satisfactorily solves the foregoing problem through providing a minimum flow rate sufficient to produce turbulence and/or foam within the fill pipe and the vehicle tank, irrespective of the angle of the fill pipe, so that the vacuum tube opening in the spout would be blocked, when the liquid level in the tank reaches a predetermined level, for a sufficient period of time to cause the release means to be activated to move the valve to its closed position. Therefore, by controlling the minimum flow rate, the customer receives all of the gasoline pumped through the nozzle and for which the customer is charged.

The present invention accomplishes this minimum flow rate through providing the valve with a seal which seals at a substantial distance beyond the circumference of the body passage that it is controlling rather than adjacent the circumference of the body passage. This enlarged sealing area, which is substantially the same as the bore area in which the valve moves from its closed position to its maximum open position, requires a substantially increased force to move the valve to its open position beyond that required if the seal seals at the circumference of the body passage. Thus, when the seal of the present invention ceases to be effective and allows flow through the passage, the valve has been moved to a position in which the flow rate through the passage is sufficient to produce the desired turbulence and/or foam within the fill pipe and the vehicle tank being filled.

An object of this invention is to provide a unique valve means for an automatic shut-off nozzle.

Another object of this invention is to provide an automatic shut-off nozzle having a sufficient minimum flow rate to prevent return of liquid through the vapor return means of the nozzle when the liquid level in the tank being filled reaches a predetermined level at which flow is to stop.

A further object of this invention is to provide an automatic shut-off nozzle having vapor return sealing means in which accurate dispensation of the liquid is obtained.

Other objects, uses, and advantages of this invention are apparent upon a reading of this description which proceeds with reference to the drawings forming part thereof and wherein.

Figure 1:
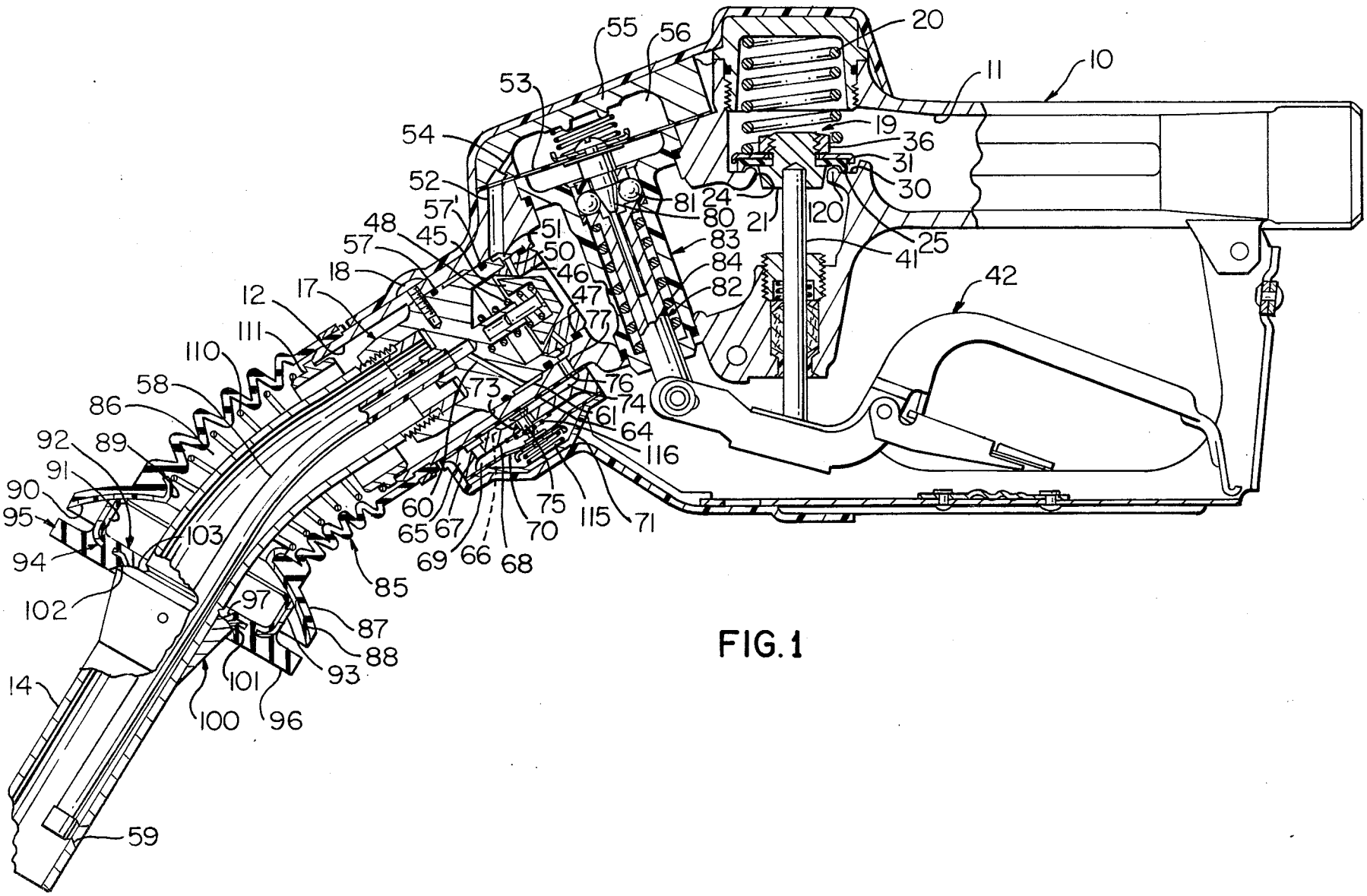
FIG. 1 is a sectional view, partly in elevation, of an automatic shut-off nozzle having the valve means of the present invention.

Referring to the drawings and particularly FIG. 1, there is shown a nozzle body 10 having an inlet 11 to which a hose is connected to supply liquid such as gasoline, for example, to the interior of the body 10. The body 10 has an outlet 12 with which a spout 14 communicates to receive liquid from the interior of the body 10.

The spout 14, which is adapted to be inserted within an opening 15 (see FIG. 3) in a fill pipe 16 of a vehicle tank such as an automobile fuel tank, for example, has an end threaded in a spout adapter 17 (see FIG. 1), which is connected to the outlet 12 of the body 10 by a screw 18.

The body 10 has a first or main poppet valve 19 supported therein for control of the flow of liquid from the inlet 11 to the interior of the body 10 and from the interior of the body 10 to the outlet 12. A spring 20 continuously urges the poppet valve 19 to its closed position in which flow from the inlet 11 to the outlet 12 is stopped or prevented.

The poppet valve 19 includes a skirt 21 (see FIG. 2) having a reduced upper portion 22. The skirt 21 has its lower portion 23 disposed within a passage 24 (see FIG. 1) in the body 10 and slidably disposed therein. The lower portion 23 (see FIG. 2) of the skirt 21 has a larger diameter at its upper end than at its lower end.

The main poppet valve 19 includes an annular seal 25, which has an inner portion of its lower surface 26 resting on an annular shoulder 27 of the skirt 21. The annular seal 25 has an opening 28 in its center to have the reduced portion 22 of the skirt 21 pass therethrough. The seal 25 has a downwardly depending continuous lip 29 at its circumference for engagement with a surface 30 (see FIG. 1) of the body 10. The lip 29 engages the surface 30 outside of the diameter of passage 24 to form a relatively larger sealing area relative to the area of the passage 24 through which the liquid flows when the main poppet valve 19 is in its open position.

Figure 2:
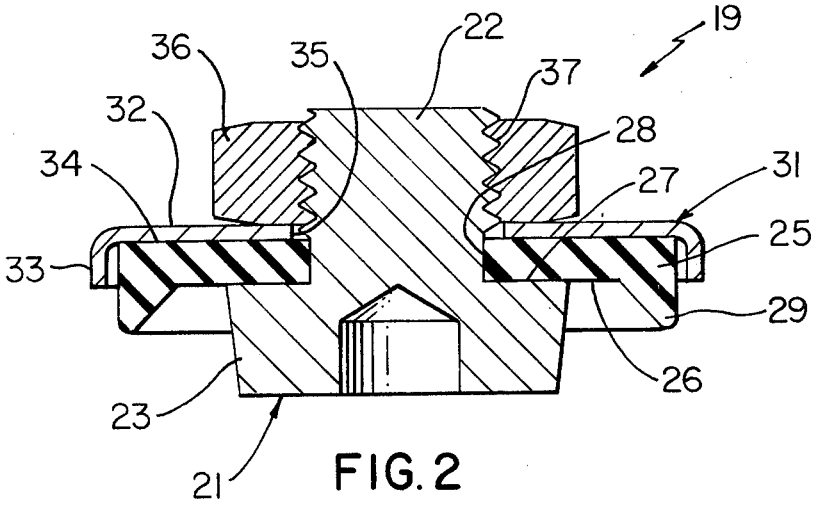
FIG. 2 is an enlarged sectional view of the valve means of the present invention.

A seal holder 31 (see FIG. 2), which is an annular plate 32 having a downwardly depending lip 33, overlies upper surface 34 of the seal 25 and has the lip 33 disposed beyond the circumference of the seal 25 as shown in FIG. 2. The plate 32 of the seal holder 31 has an opening 35 therein of larger diameter than the reduced portion 22 of the skirt 21 to have the reduced portion 22 of the skirt 21 pass therethrough.

The seal holder 31 is held in engagement with the upper surface 34 of the seal 25, and the seal 25 has its lower surface 26 held in engagement with the annular shoulder 27 of the skirt 21 by a nut 36, which is threaded on threads 37 of the upper end of the reduced portion 22 of the skirt 21. The nut 36 is staked to the reduced portion 22 of the skirt 21.

A stem 41 (see FIG. 1) is connected to the skirt 21 of the poppet valve 19 and has its lower portion extending exteriorly of the body 10. The valve stem 41, which is slidably disposed within the body 10, is moved by a manually operated lever or handle 42. The stem 41 passes through the body 10 in the same manner as described in U.S. Pat. No. 3,811,486 to Wood.

Figure 5:
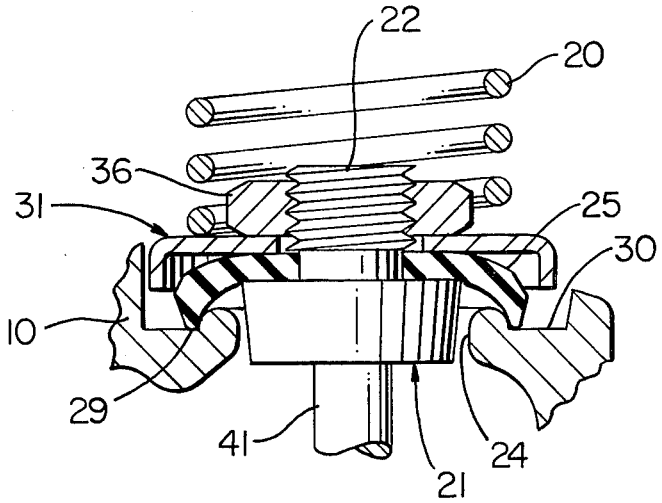
FIG. 5 is a fragmentary sectional view of the valve of the present invention, similar to FIG. 4, but showing the valve skirt being lifted from the position of FIG. 4 with the seal still being effective.

When the stem 41 is moved upwardly by the handle 42, the flexibility of the annular seal 25 and its diameter enables the lip 29 of the seal 25 to remain in engagement with the surface 30 (see FIG. 5) of the body 10 while the skirt 21 is moving upwardly within the passage 24. The fluid pressure in the inlet 11 acting on the upper surface 34 of the flexible seal 25 enables the seal 25 to continue to engage the surface 30 (see FIG. 5) of the body 10 while upward motion of the skirt 21 is occurring. The seal 25 is formed of a suitable flexible material such as rubber so that it flexes to remain in engagement with the surface 30 of the body 10 when upward motion of the skirt 21 is occurring.

Figure 6:
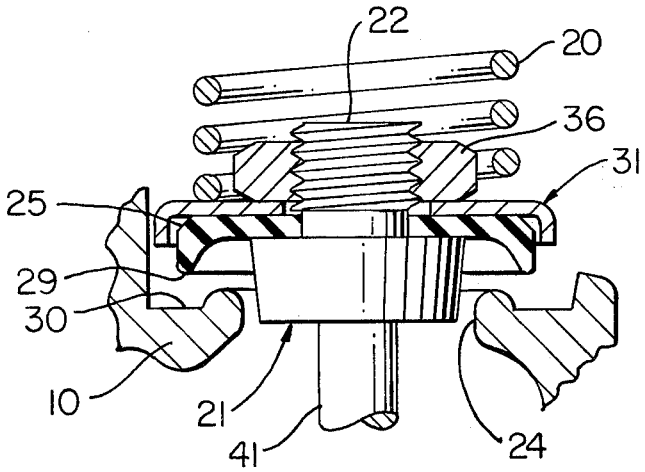
FIG. 6 is a fragmentary sectional view of the valve of the present invention, similar to FIGS. 4 and 5, but showing the skirt having been lifted from the position of FIG. 5 so as to have moved the seal away from its sealing position to enable a minimum flow rate through the body passage.

As shown in FIG. 6, the continued upward movement of the skirt 21 by the handle 42 moving the stem 41 upwardly results in the seal 25 ceasing to engage the surface 30 of the body 10 whereby liquid flows between the skirt 21 and the passage 24. As shown in FIG. 6, there is a predetermined minimum opening between the skirt 21 and the passage 24 at the time that the seal 25 ceases to engage the surface 30 of the body 10. This insures that a predetermined minimum flow rate is occurring whenever the seal 25 of the poppet valve 19 ceases to engage the surface 30 of the body 10.

A second poppet valve 45 is slidably mounted on the spout adapter 17 and is continuously urged into engagement with a seat ring 46, which is secured to the spout adapter 17, by a spring 48. A sealing ring 47 is disposed between the seat ring 46 and the body 10 to prevent leakage therebetween. Thus, only the pressure of liquid flowing from the inlet 11 and past the main poppet valve 19 can overcome the spring 48 to move the second poppet valve 45 to an open position.

As the liquid flows between the second poppet valve 45 and the seat ring 46, a venturi effect is created in radially extending passages 50 in the seat ring 46. The outer ends of the passages 50 communicate with an annular chamber 51, which is formed between the body 10, the spout adapter 17, and the seat ring 46. The passages 50 communicate through the chamber 51, a passage 52 in the body 10, an opening in a diaphragm 53, and a passage 54 in a cap 55 to a chamber 56, which is formed between the diaphragm 53 and the cap 55.

Sealing rings 57 and 57' are disposed between the spout adapter 17 and the body 10. These prevent air from entering the chamber 51 from exterior of the body 10.

The chamber 51 also communicates with a vacuum tube 58, which is connected with an opening 59 in the spout 14 adjacent the discharge or free end of the spout 14. The tube 58 communicates through a passage 60 in the spout adapter 17 with a chamber 61, which is formed between the sealing rings 57 and 57', the spout adapter 17, and the body 10. The chamber 61 communicates through a passage (not shown) in the nozzle body 10 and an opening (not shown) in a seal 64, which is disposed between the body 10 and a housing 65 secured to the body 10, to a horseshoe-shaped passage 66 in the housing 65. This is more particularly shown in the copending patent application of Jack A. McMath et al for "Automatic Shut-Off Nozzle With Vapor Return Seal," Ser. No. 684,441, filed May 7, 1976, refiled as continuation Ser. No. 856,108 on Nov. 30, 1977, and assigned to the same assignee as the assignee of this application.

The horseshoe-shaped passage 66 in the housing 65 communicates through a passage 67 in a divider 68 of the housing 65 with a chamber 69, which is formed between the divider 68 and a diaphragm 70. A retainer 71 holds the diaphragm 70 on the housing 65.

The chamber 69 communicates through a passage 73 in the divider 68 of the housing 65 with a chamber 74, which is formed within the housing 65 between the divider 68 and the seal 64. The passage 73 is controlled by a poppet valve 75, which is responsive to the diaphragm 70. The chamber 74 communicates through an opening 76 in the seal 64 and a passage 77 in the body 10 with the annular chamber 51.

Accordingly, as long as the poppet valve 75 is open and the opening 59 is not closed due to the liquid within the tank reaching a predetermined level that indicates that the tank is filled, the venturi effect created by the flow of the liquid between the seat ring 46 and the second poppet valve 45 draws air through the tube 58 to create a partial vacuum within the chamber 56. However, as soon as the opening 59 is blocked or the valve 75 is closed, the chamber 56 has its pressure reduced due to the air therein being drawn therefrom because of the venturi effect in the passages 50 whereby the diaphragm 53 moves upwardly since the partial vacuum in the chamber 56 is increased. This venturi effect is more particularly described in U.S. Pat. No. 3,085,600 to Briede.

The diaphragm 53 has a latch retaining pin 80 secured thereto for movement therewith and disposed between three balls 81 (two shown), which are positioned within passages in a latch plunger 82. When the latch retaining pin 80 is in the position shown in FIG. 1, the balls 81 prevent downward movement of the plunger 82, which is slidably mounted within an insert 83. The insert 83, which is preferably formed of a plastic, is supported in the body 10.

When the diaphragm 53 is moved upwardly due to the increase in the partial vacuum in the chamber 56, the latch retaining pin 80 is moved upwardly therewith. The upward movement of the retaining pin 80 disposes a tapered portion of the retaining pin 80 between the balls 81 whereby the balls 81 may move inwardly to allow the plunger 82 to be moved downwardly against the force of its spring 84. The correlation between the tapered portion of the pin 80 and the latch plunger 82 is more specifically shown in U.S. Pat. No. 2,582,195 to Duerr.

The lower end of the plunger 82 is connected to the handle 42 as more particularly shown and described in U.S. Pat. No. 3,817,285 to Wilder et al. Thus, when the diaphragm 53 moves upwardly to pull the latch retaining pin 80 and release the latch plunger 82 from the balls 81, the force of the spring 20 closes the main poppet valve 19 as more particularly shown and described in the aforesaid Wilder et al patent.

The body 10 has a bellows 85, which is preferably formed of a gasoline resistant synthetic rubber, secured thereto and extending from the outlet 12 of the body 10 towards the free or discharge end of the spout 14. The bellows 85 is disposed in spaced relation to the spout 14 to form an annular passage 86 there between.

The end of the bellows 85 remote from the outlet 12 of the body 10 has a member 87, which is preferably formed integral therewith. The member 87 has a member 88, which is plastic such as acetal plastic for example, connected by the member 88 having its curved portion snapped into the bellows 85 and retained therein by the resilience of the bellows 85. The member 88 has an opening 89 formed in the center thereof to enable the member 88 to slide along the spout 14.

The member 88 has its surface 90 formed as a sector of a sphere so that a cylindrical extension 91 of a member 92, which is preferably formed of the same material as the member 87, engages the surface 90 irrespective of the position of the member 92 on the spout 14. The member 92 has its cylindrical extension 91 supported by a cylindrical extension 93 of a plate 94, which is preferably formed of a suitable metal such as stainless steel, for example. The member 92 is molded integral with the plate 94 so that the cylindrical extension 91 of the member 92 is secured to the cylindrical extension 93 of the plate 94.

The plate 94 has openings formed therein so that the member 92 has a disc 95 disposed on the opposite side of the plate 94 from the cylindrical extension 91. Thus, the member 92, the plate 94, and the disc 95 form a sealing member with the disc 95 having its flat surface 96 functioning as a sealing surface. The member 92, the plate 94, and the disc 95 have an opening 97 to enable them to be both slidably and rotatably mounted on the spout 14.

A retainer 100, which functions as a stop, is fixed to the spout 14 between the disc 95 and the discharge or free end of the spout 14 by suitable means such as a set screw or welding, for example. The retainer 100 has a curved surface 101, preferably formed as a portion of a sphere as more particularly shown and described in the copending patent application of Donald A. Lasater for "Liquid Dispensing Nozzle Having Vapor Recovery And Sealing Arrangement," Ser. No. 581,718, filed May 29, 1975, now U.S. Pat. No. 4,003,415, and assigned to the same assignee as the assignee of this application. The disc 95 has an inner curved surface 102, preferably formed as a sphere as more particularly shown and described in the aforesaid Lasater application, engaging the curved surface 101 of the retainer 100 to form a seal therewith when the spout 14 is not inserted within the opening 15 of the fill pipe 16.

The retainer 100 has an inner flat surface 103, which is disposed inside of the surface 101. The surface 103 functions to lock the spout 14 within the fill pipe 16 through cooperation with a lip 104 of the fill pipe 16 as shown in FIG. 3.

Accordingly, when the spout 14 is not inserted in the opening 15 of the fill pipe 16, the annular passage 86, which is connected to the vapor recovery equipment, is not connected to the atmosphere but is sealed through the cylindrical extension 91 of the member 92 engaging the surface 90 of the member 88 and the disc 95 having its inner curved surface 102 engage the outer curved surface 101 of the retainer 100. When the spout 14 is inserted into the opening 15 (see FIG. 3) of the fill pipe 16, the outer flat surface 96 of the disc 95 abuts the end of the fill pipe 16 so as to not follow the movement of the spout 14 and the retainer 100 into the fill pipe 16. This results in the bellows 85, which continuously urges the member 88 toward the free end of the spout 14 so that the spherical surface 90 of the member 88 is always in engagement with the cylindrical extension 91 of the member 92 and the cylindrical extension 93 of the plate 94, being slightly compressed.

Figure 3:
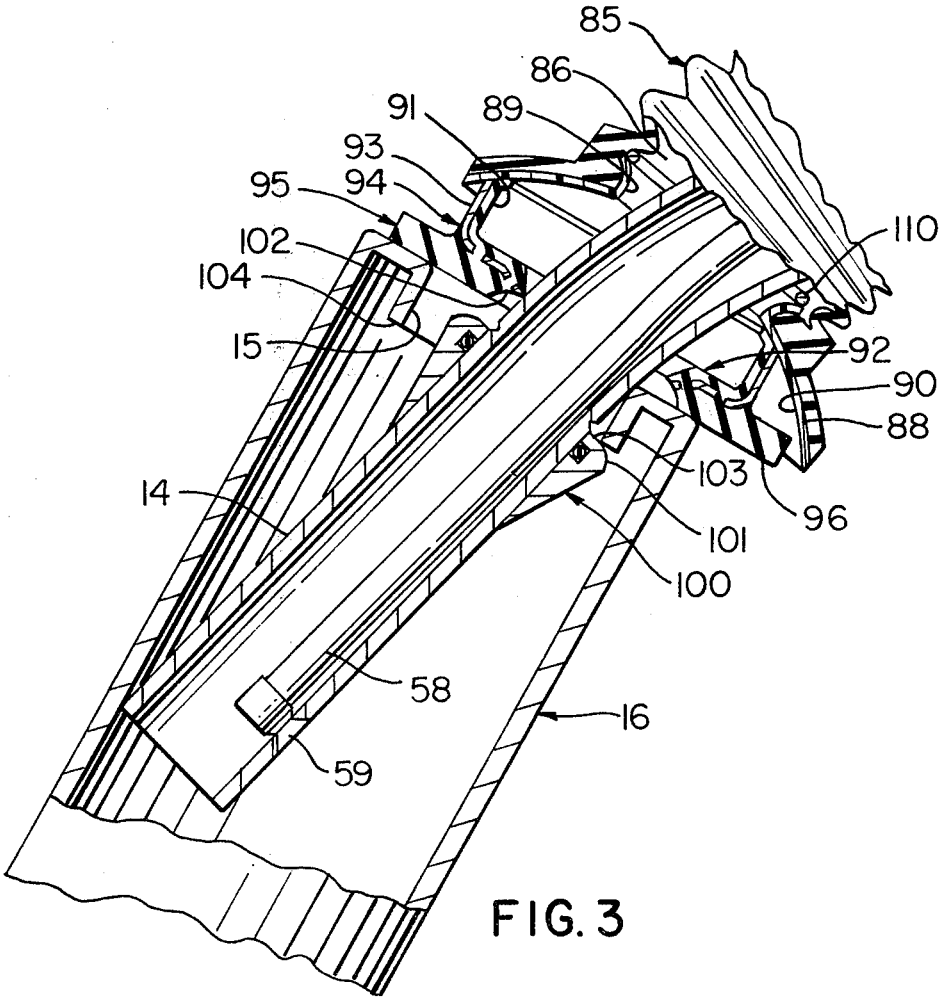
FIG. 3 is a fragmentary sectional view, partly in elevation, of a portion of the nozzle of FIG. 1 and showing the spout in the fill pipe of a vehicle tank with the seal of the vapor return means being effective.

Accordingly, when the spout 14 is in the position of FIG. 3, vapor within the tank can flow through the opening 15 in the fill pipe 16 and the opening 89 into the annular passage 86 from which it flows to the vapor recovery equipment. Thus, the movement of the spout 14 into the fill pipe opening 15 results in the seal between the disc 95 and the retainer 100 being broken whereby the vapor can be removed from the tank being filled.

It should be understood that a spring 110 continuously urges the disc 95 into engagement with the retainer 100. The upper end of the spring 110 engages an annular sleeve 111, which has its movement limited by engaging the outlet end of the body 10. The annular sleeve 111 enables the vapors to pass between the annular sleeve 111 and the spout 14.

As previously mentioned, the poppet valve 75 is responsive to the diaphragm 70, which has one end of a spring 115 acting thereagainst. The other end of the spring 115 acts against the retainer 71. A spring 116 has one end disposed in a groove in the poppet valve 75 so that the spring 116 urges the poppet valve 75 to its closed position, but the force of the spring 116 is not as strong as the force of the spring 115, which urges the poppet valve 75 to its normally open position through a rivet in the diaphragm 70 being held against the end of the poppet valve 75 by the spring 115.

However, if the vapor pressure in the tank, which is being filled and has the fill pipe opening 15 sealed by the flat surface 96 of the disc 95 engaging the end of the fill pipe 16, increases beyond a predetermined pressure, the diaphragm 70 is moved against the force of the spring 115 to permit the poppet valve 75 to move to its closed position in response to the action of the spring 116. When this occurs, air from the opening 59 to the passages 50 in the seat ring 46 is stopped so that the partial vacuum in the chamber 56 is increased to cause automatic closing of the main poppet valve 19. This response of the diaphragm 70 to the vapor pressure in the sealed tank is more particularly shown and described in the aforesaid Wood patent.

Figure 4:
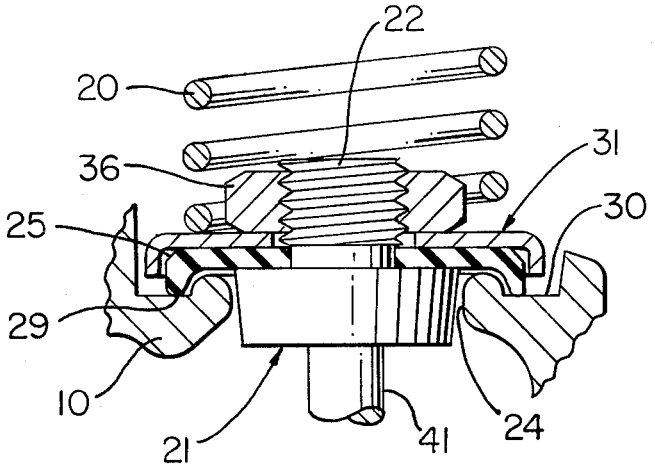
FIG. 4 is a fragmentary sectional view of the valve of the present invention when no lifting force is applied.

Considering the operation of the present invention, the poppet valve 75 is normally in an open position as shown in FIG. 1. With the valve 75 in this position and the spout 14 disposed in the fill pipe opening 15, opening of the main poppet valve 19 by the handle 42 causes upward motion of the skirt 21 of the main poppet valve 19 against the force of the spring 20 so that the skirt 21 moves from the position of FIG. 4 to the position of FIG. 5 and then to the position of FIG. 6 as the force acting on the stem 41 through the handle 42 is increased. Because of the flexibility of the seal 25 and the differential pressure thereacross, the seal 25 is deflected downwardly as the force acting on the stem 41 through the handle 42 is increased so that the seal 25 continues to remain in engagement with the surface 30 of the body 10 until the skirt 21 has reached the position in which there is a predetermined minimum opening between the skirt 21 and the passage 24.

Accordingly, this results in the main poppet valve 19 opening sufficiently to provide a minimum flow rate through the passage 24 capable of blocking the opening 59 in the spout 14 when the liquid level in the tank reaches the predetermined level irrespective of the angle of the fill pipe 16. When the opening 59 to the vacuum tube 58 is blocked, the partial vacuum in the chamber 56 increases because of the absence of air from the opening 59 to the passages 50 in the seat ring 46 so that the diaphragm 53 moves upwardly to cause automatic closing of the main poppet valve 19.

By making the sealing area of the seal 25 substantially the same as the effective bore area through which the main poppet valve 19 moves, a relatively large force is required to open the main poppet valve 19. Therefore, any effort by the attendant to attempt to throttle the flow through the passage 24 in the body 10 by the main poppet valve 19 is prevented because the force of the liquid acting on the seal 25 of the main poppet valve 19 moves the main poppet valve 19 to its closed position when the flow rate through the passage 24 drops below that necessary to produce sufficient turbulence and/or foam within the tank to block the opening 59 to the vacuum tube 58 when the level in the tank reaches its predetermined level.

If the vapor pressure in the tank should exceed a predetermined pressure, then the diaphragm 70 moves the poppet valve 75 to its closed position. When this occurs, the partial vacuum in the chamber 56 is increased in the same manner as when the opening 59 to the vacuum tube 58 is blocked by the level of the liquid in the tank being filled since each effectively causes an increase in the partial vacuum in the chamber 56 because of the inability of the venturi to draw air from the opening 59 through the passages 50 in the seat ring 46.

While the seal 25 has been shown as having the lip 29 engaging the surface 30 of the body 10, it should be understood that the surface 30 of the body 10 could have a raised seat for engaging the seal 25 adjacent its circumference whereby the lip 29 could be omitted. The seal 25 has been shown for utilization with the body 10 having a seat 120 surrounding the passage 24. This is to enable the seal 25 to be used with nozzles already on the market in which the seat 120 surrounds the circumference of the passage 24.

An advantage of this invention is that all gasoline pumped is normally supplied to the purchaser. Another advantage of this invention is that gasoline supplied to a vehicle tank cannot be easily withdrawn therefrom through the vapor return passages.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. An automatic shut-off nozzle comprising a body having an inlet and an outlet; a spout communicating with said outlet and having its free end for disposition in an opening of a fill pipe of a vehicle tank or the like; said body having a passage between said inlet and said outlet; valve means in said body to control flow of liquid from said inlet to said outlet by controlling flow through said passage; means urging said valve means to its closed position; manual operated means controlling the operation of said valve means; release means to release said manual operated means to allow closing of said valve means and stoppage of liquid flow; means to return vapor from the tank being filled; sealing means to form a seal between the fill pipe opening and said vapor return means when said spout is disposed in the fill pipe; means to activate said release means to close said valve means to stop liquid flow through said body when the level of liquid in the tank reaches a predetermined level; said valve means including means slidably disposed in said passage and sealing means supported on said slidably disposed means; seal engaging means in surrounding relation to a portion of said passage for engagement by said sealing means to seal the portion of said passage to prevent flow from said inlet to said outlet; and said slidably disposed means having first means downstream of said sealing means and disposed in the portion of said passage downstream of said sealing means when said sealing means engages said seal engaging means to prevent flow through said passage, said sealing means engaging said seal engaging means to prevent flow from said inlet to said outlet until a predetermined opening is provided between said first means of said slidably disposed means downstream of said sealing means and the portion of said passage to enable liquid to flow therebetween to said outlet by movement of said slidably disposed means by said manual operated means.

2. The nozzle according to claim 1 in which said sealing means of said valve means extends substantially beyond the periphery of said slidably disposed means to seal said passage at substantially the periphery of said sealing means of said valve means to require a predetermined lift to be applied to said slidably disposed means by said manual operated means to dispose said first means of said slidably disposed means relative to the portion of said passage when said sealing means of said valve means becomes ineffective to maintain a minimum flow rate through said passage sufficient to enable said activating means to be effective when the liquid level in the tank reaches the predetermined level irrespective of the angle of the fill pipe.

3. The nozzle according to claim 2 in which the periphery of said sealing means of said valve means extends beyond the area of said urging means in a direction substantially normal to that in which said slidably disposed means moves.

4. The nozzle according to claim 3 in which said sealing means of said valve means has a continuous lip projecting downwardly therefrom at is periphery to engage said seal engaging means to seal said passage.

5. The nozzle according to claim 2 in which said sealing means of said valve means has a continuous lip projecting downwardly therefrom at its periphery to engage said seal engaging means to seal said passage.

6. The nozzle according to claim 5 in which said sealing means of said valve means has a sealing area substantially the same as the effective bore area through which said valve means moves.

7. The nozzle according to claim 5 in which said sealing means is formed of a flexible material to enable said sealing means to remain effective until said first means of said slidably disposed means has been lifted a predetermined distance by said manual operated means to form the predetermined opening.

8. The nozzle according to claim 2 in which said sealing means of said valve means has a sealing area substantially the same as the effective bore area through which said valve means moves.

9. The nozzle according to claim 8 in which said sealing means is formed of a flexible material to enable said sealing means to remain effective until said first means of said slidably disposed means has been lifted a predetermined distance by said manual operated means to form the predetermined opening.

10. The nozzle according to claim 2 in which said sealing means is formed of a flexible material to enable said sealing means to remain effective until said first means of said slidably disposed means has been lifted a predetermined distance by said manual operated means to form the predetermined opening.

11. The nozzle according to claim 1 in which said sealing means of said valve means has a continuous lip projecting downwardly therefrom at its periphery to engage said seal engaging means to seal said passage.

12. The nozzle according to claim 11 in which said sealing means extends beyond the periphery of said first means of said slidably disposed means and is formed of a flexible material to enable said sealing means to remain effective until said first means of said slidably disposed means has been lifted a predetermined distance by said manual operated means to form the predetermined opening.

13. The nozzle according to claim 1 in which said sealing means of said valve means has a sealing area substantially the same as the effective bore area through which said valve means moves.

14. The nozzle according to claim 13 in which said sealing means extends beyond the periphery of said first means of said slidably disposed means and is formed of a flexible material to enable said sealing means to remain effective until said first means of said slidably disposed means has been lifted a predetermined distance by said manual operated means to form the predetermined opening.

15. The nozzle according to claim 1 including means to prevent said sealing means of said valve means from being rendered ineffective during movement of said first means of said slidably disposed means for a predetermined distance within the portion of said passage downstream of said sealing means of said valve means whereby the predetermined opening is provided between said first means of said slidably disposed means and the portion of said passage before said sealing means of said valve means is ineffective.

16. The nozzle according to claim 15 in which said sealing means is formed of a flexible material to enable said sealing means to remain effective until said first means of said slidably disposed means has been lifted the predetermined distance by said manual operated means to form the predetermined opening.

17. The nozzle according to claim 1 in which said first means of said slidably disposed means includes a skirt movable by said manual operated means, said sealing means is supported on the upper surface of said skirt, said sealing means extends beyond the periphery of said skirt and engages said seal engaging means to form the only seal of the portion of said passage by said sealing means, and said sealing means is formed of a flexible material to enable said sealing means to remain effective through engagement with said seal engaging means until said skirt has been lifted a predetermined distance by said manual operated means to form the predetermined opening between said skirt and the portion of said passage downstream of said sealing means.

18. The nozzle according to claim 17 in which said sealing means includes a substantially planar portion supported on the upper surface of said skirt and extending beyond the periphery of said skirt and a continuous lip at the end of said substantially planar portion and projecting downwardly therefrom to engage said seal engaging means to seal said passage, said lip being spaced from the outer surface of said skirt at all times.

19. The nozzle according to claim 18 in which said skirt has a cross sectional area smaller than the area of the portion of said passage to provide an uninterrupted space between said skirt and the portion of said passage at all times with the size of the space increasing as said skirt is lifted by said manual operated means to produce the predetermined opening between said slidably disposed means and the portion of said passage when said skirt has been lifted the predetermined distance.

20. The nozzle according to claim 17 in which said skirt has a cross sectional area smaller than the area of the portion of said passage to provide an uninterrupted space between said skirt and the portion of said passage at all times with the size of the space increasing as said skirt is lifted by said manual operated means to produce the predetermined opening between said slidably disposed means and the portion of said passage when said skirt has been lifted the predetermined distance.

21. The nozzle according to claim 1 in which said first means of said slidably disposed means includes a skirt movable by said manual operated means, said skirt has a decreasing cross sectional area from its top to its bottom, and said skirt has its largest cross sectional area smaller than the cross sectional area of the portion of said passage to provide an uninterrupted space between said skirt and the portion of said passage downstream of said sealing means at all times with the space increasing as said skirt is lifted by said manual operated means to produce the predetermined opening between said slidably disposed means and the portion of said passage when said skirt has been lifted a predetermined distance.

22. The nozzle according to claim 21 in which said sealing means extends beyond the periphery of said skirt and is formed of a flexible material to enable said sealing means to remain effective until said skirt has been lifted the predetermined distance by said manual operated means to form the predetermined opening.

23. The nozzle according to claim 1 in which said sealing means extends beyond the periphery of said first means of said slidably disposed means and is formed of a flexible material to enable said sealing means to remain effective until said first means of said slidably disposed means has been lifted a predetermined distance by said manual operated means to form the predetermined opening.

* * * * *